US007955025B2

(12) United States Patent
Murphy et al.

(10) Patent No.: US 7,955,025 B2
(45) Date of Patent: Jun. 7, 2011

(54) TILE FOR SYNTHETIC GRASS SYSTEM

(75) Inventors: Stephen Murphy, Ile Bizard (CA); Jean Prevost, Westmount (CA)

(73) Assignee: Fieldturf Tarkett Inc., TMR-Montreal (CA)

( * ) Notice: Subject to any disclaimer, the term of this patent is extended or adjusted under 35 U.S.C. 154(b) by 0 days.

(21) Appl. No.: 12/286,897

(22) Filed: Oct. 2, 2008

(65) Prior Publication Data

US 2009/0094918 A1 Apr. 16, 2009

Related U.S. Application Data

(60) Provisional application No. 60/997,469, filed on Oct. 2, 2007.

(51) Int. Cl.
*E01C 5/00* (2006.01)

(52) U.S. Cl. ..... 404/35; 404/41

(58) Field of Classification Search ..... 52/382, 52/581, 589.1, 597, 598; 404/34–36, 38, 404/40, 41, 45

See application file for complete search history.

(56) References Cited

U.S. PATENT DOCUMENTS

| | | | | | |
|---|---|---|---|---|---|
| 16,692 | A * | 2/1857 | Mettam | 404/41 |
| 2,918,151 | A * | 12/1959 | Kennedy | 52/588.1 |
| 4,167,599 | A * | 9/1979 | Nissinen | 428/44 |
| 4,596,731 | A * | 6/1986 | Cudmore et al. | 428/134 |
| 4,826,351 | A * | 5/1989 | Haberhauer et al. | 404/35 |
| 4,917,532 | A * | 4/1990 | Haberhauer et al. | 404/35 |
| 5,281,459 | A * | 1/1994 | Van Eijck | 428/100 |
| 5,364,204 | A * | 11/1994 | MacLeod | 404/35 |
| 5,527,128 | A * | 6/1996 | Rope et al. | 404/35 |
| 5,616,389 | A * | 4/1997 | Blatz | 428/45 |
| 5,833,386 | A * | 11/1998 | Rosan et al. | 404/36 |
| 6,032,428 | A * | 3/2000 | Rosan et al. | 52/592.1 |
| 6,089,784 | A * | 7/2000 | Ardern | 404/41 |
| 6,558,070 | B1 * | 5/2003 | Valtanen | 404/35 |
| 6,669,572 | B1 | 12/2003 | Barlow | |
| 6,954,975 | B2 * | 10/2005 | Dolinski | 29/428 |
| 7,160,055 | B2 * | 1/2007 | Beamish et al. | 404/36 |
| 7,229,232 | B2 * | 6/2007 | Amelung, Sr. | 404/36 |
| 7,300,224 | B2 * | 11/2007 | Slater | 404/36 |
| 7,544,010 | B2 * | 6/2009 | Restrepo et al. | 404/21 |
| 2005/0223666 | A1 * | 10/2005 | Forster et al. | 52/392 |
| 2006/0084513 | A1 | 4/2006 | De Vries et al. | |
| 2008/0216437 | A1 * | 9/2008 | Prevost et al. | 52/589.1 |

OTHER PUBLICATIONS

PCT International Search Report for PCT/US2008/011414, International Filing Date of Oct. 2, 2008, 2 pages.

PCT Written Opinion o the International Searching Authority for PCT/US2008/011414, International Filing Date of Oct. 2, 2008, 4 pages.

* cited by examiner

*Primary Examiner* — Gary S Hartmann

(74) *Attorney, Agent, or Firm* — Factor & Lake, Ltd.

(57) ABSTRACT

An array of tiles for use in a synthetic grass system. The array includes a plurality of tiles wherein a first tile has attachment members on three sides and complementary attachment members on the fourth side and a second tile includes two sets of adjacent sides, the first set having attachment members and the second set having complementary attachment members.

13 Claims, 4 Drawing Sheets

TILE FOR SYNTHETIC GRASS SYSTEM

RELATED APPLICATIONS

The present application claims the benefit of provisional application No. 60/997,469 filed on Oct. 2, 2007, the entirety of which is incorporated herein.

DESCRIPTION

The present invention relates to a tile and a tile array intended for use beneath synthetic grass systems, as well as a method of installing same.

BACKGROUND OF THE INVENTION

Beneath a synthetic grass system it is not uncommon to utilize a drainage system. These drainage systems include, among other things, an array of tiles.

Utilizing tiles beneath a synthetic grass system has multiple benefits. For example, tiles can be utilized to aide in drainage by maximizing the distance between the synthetic grass system and the base, typically which comprises crushed stone. The added space allows water to drain from the synthetic grass system to the base without flooding the synthetic grass system.

Additionally, utilizing a tile beneath a synthetic grass system can increase the shock absorbing characteristics of the synthetic grass system. It is important for safety that the synthetic grass system maintains a certain level of "give." A tile can add to the shock absorbing characteristics of the synthetic grass system through utilization of a material that is slightly flexible-especially when compared to the crushed stone base beneath the tiles.

Installation of the tiles consists of an installation team laying down the tiles and connecting adjacent ones. However, based upon the configuration of the tiles, installation begins at one end of the surface to be covered and slowly proceeds in one direction.

It would be advantageous to provide a tile and/or tile array that decreases the installation time associated with installing tiles beneath a synthetic grass system.

Therefore, it is an object of the present invention to provide a tile that can decrease the installation time associated with installation of an array of tiles beneath a synthetic grass system.

SUMMARY OF THE INVENTION

In one aspect of the invention, the invention comprises a tile to be installed beneath a synthetic grass system. The tile is laid down in the center of the field and allows for additional tiles to be installed on either side of tile at the same time. This allows two installation teams to install the additional tiles at the same time.

In another aspect of the invention the tile laid down in the center of the field has male attachment members located on three sides thereof. Complementary attachment members are on the fourth side. The complementary attachment members are configured such that they are pressed down and are detachably secured to the attachment members. This allows the installation teams to quickly press down on additional tiles as they are installed and does not require previously laid tiles to be picked up in order to be attached to additional tiles. Once again, this will decrease the amount of time required for installing the tiles, and decrease the overall time required to install the synthetic grass system.

These and other aspects of the present invention will be appreciated and readily understood by those of skill in the art in view of the description of the preferred embodiments.

DETAILED DESCRIPTION OF THE PREFERRED EMBODIMENTS

Figure 1:
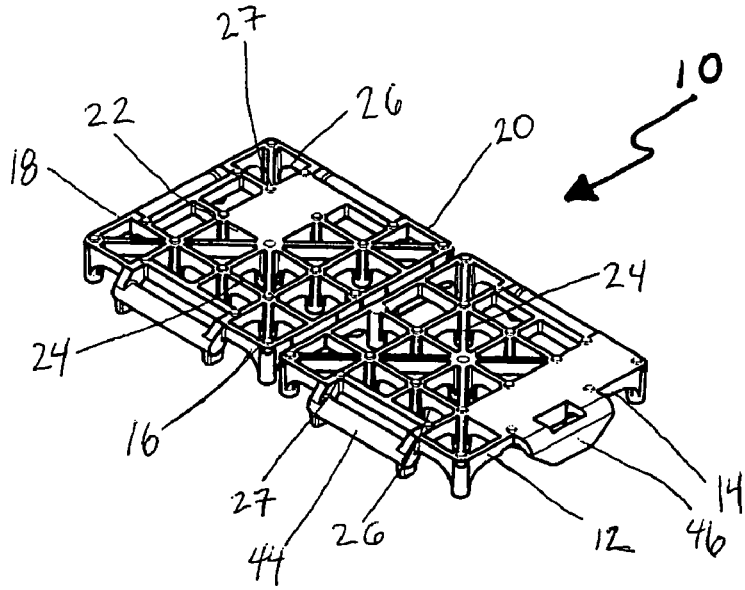
FIG. 1 is a top perspective view of a tile according to the present invention.
Figure 2:
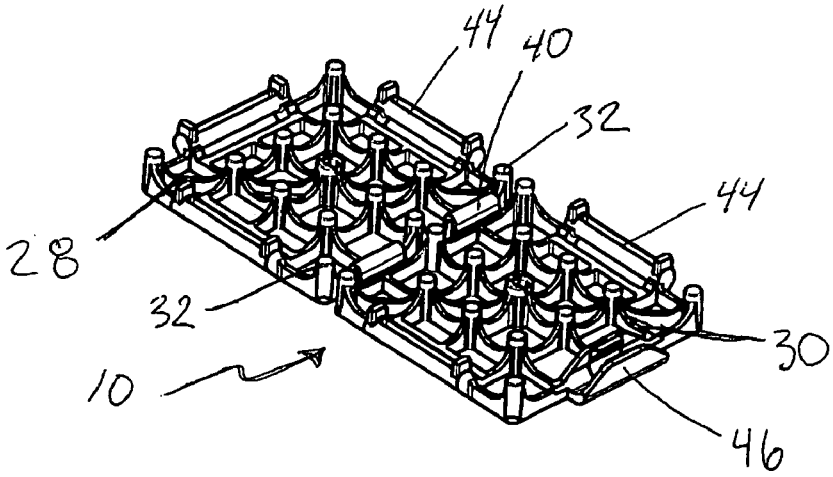
FIG. 2 is a bottom perspective view of a tile according to the present invention.
Figure 3:
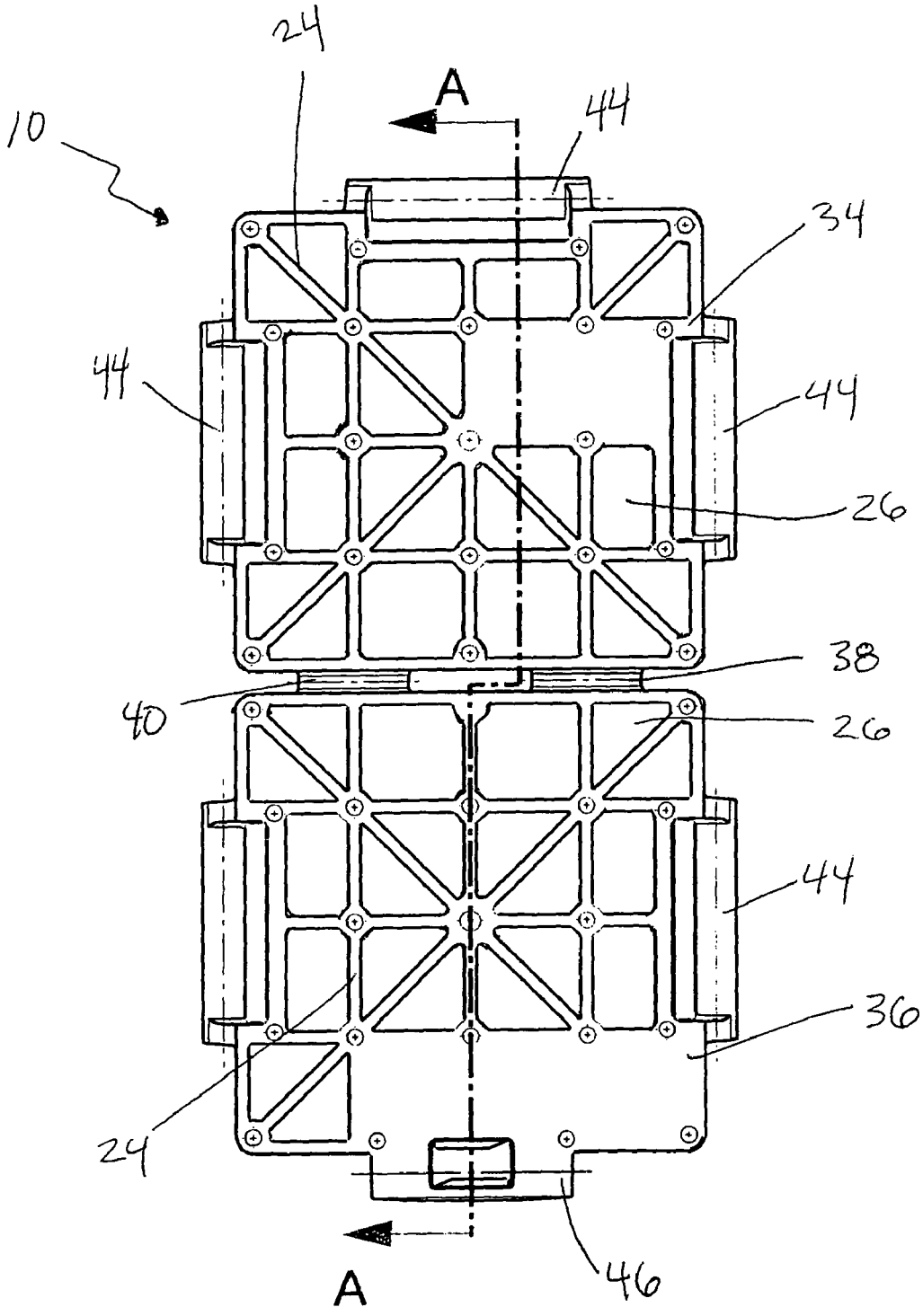
FIG. 3 is a top view of a tile according to the present invention.
Figure 4:
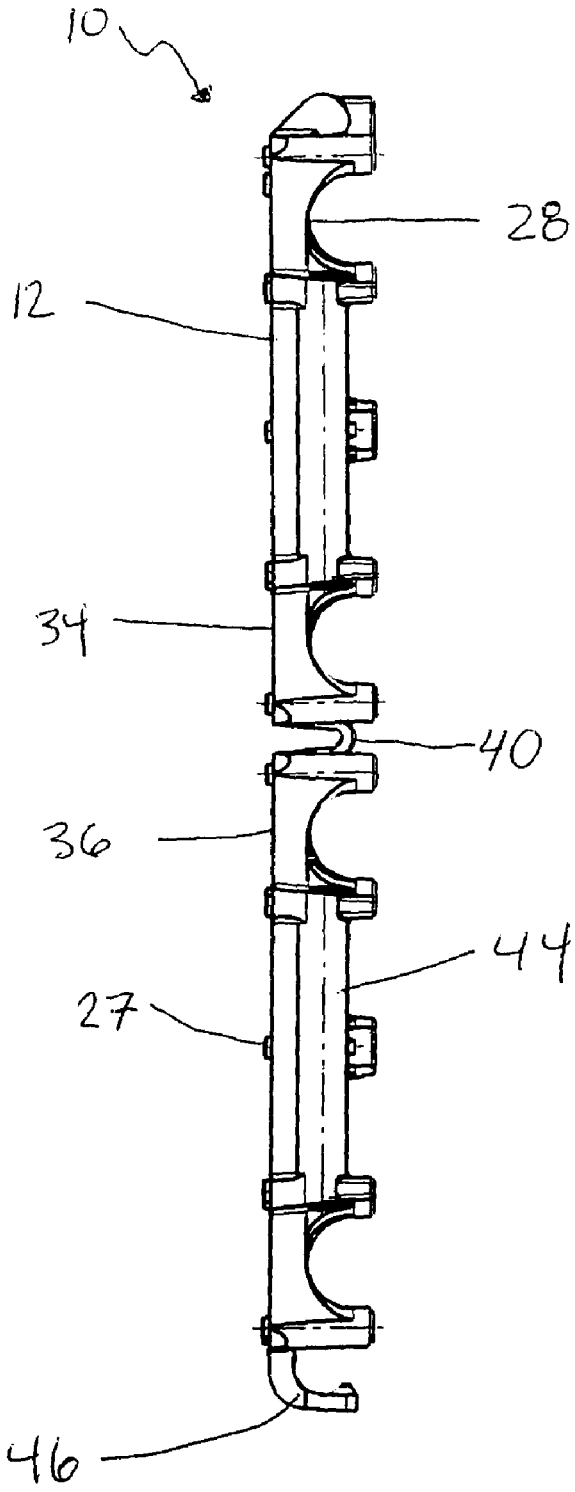
FIG. 4 is a first side view along line AA in FIG. 3.
Figure 5:
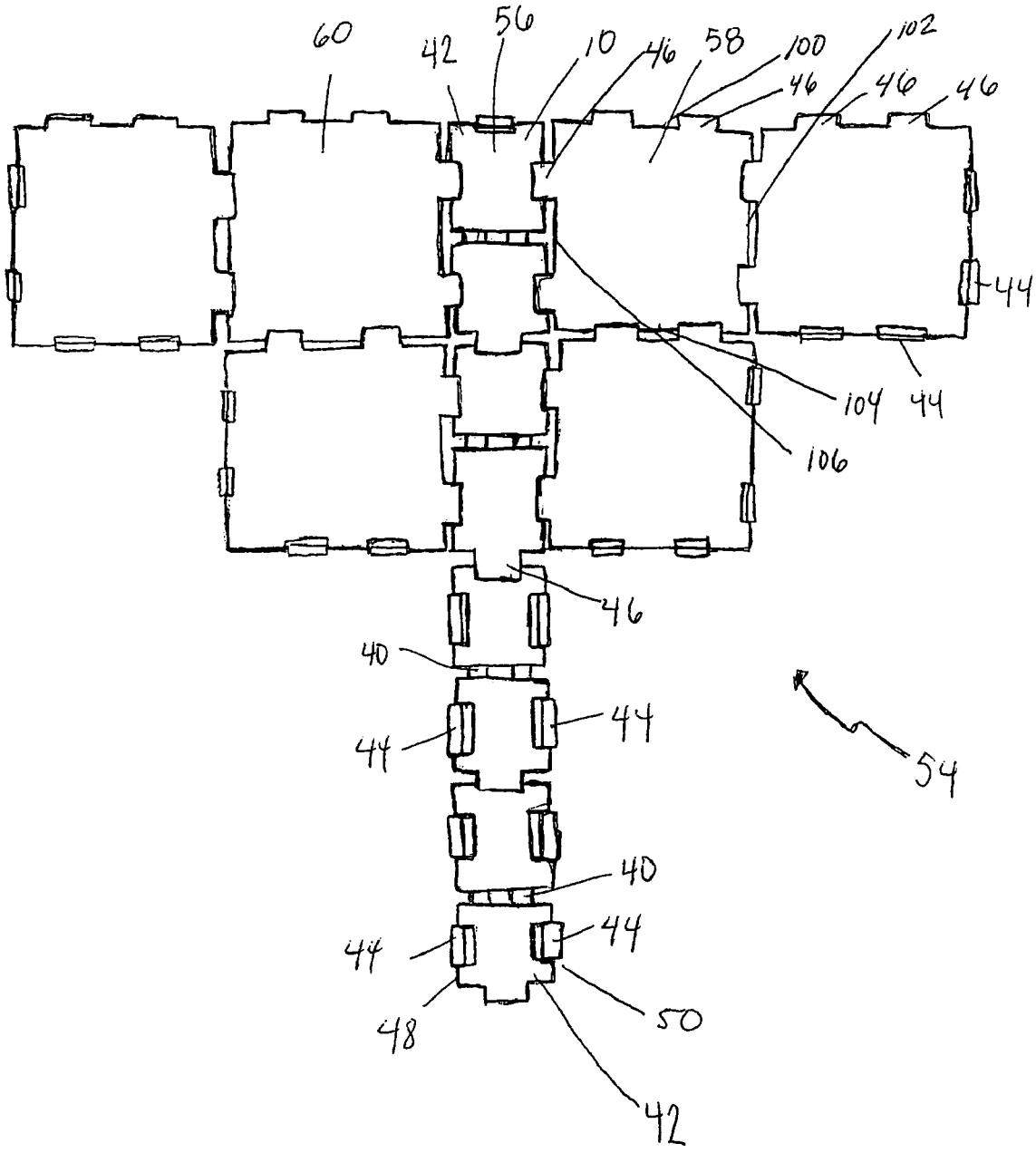
FIG. 5 is a top view of an array of tiles according to the present invention.

While this invention is susceptible of embodiment in many different forms, there is shown in the drawings and will be described in detail below, at least one specific embodiment with the understanding that the present disclosure is to be considered as an exemplification of the principles of the invention and is not intended to limit the invention to the embodiment illustrated.

It should be understood that like or analogous elements and/or components, referred to herein, are identified throughout the drawings by like reference characters. In addition, it should be understood that the drawings are merely a representation, and some of the components may have been distorted from actual scale for purposes of clarity.

A tile 10 according to the present invention includes a top portion 12 having a first side 14, a second side 16, a third side 18, a fourth side 20, and a top surface 22. The first side 14 and the third side 18 are located opposite each other, and similarly, the second side 16 and the forth side 20 are located opposite of each other.

The top portion 12 includes a top surface 22 formed, for example, by a plurality of intersecting members 24. The intersecting members 24 form a plurality of open spaces 26. These open spaces 26 may provide the tile 10 with the drainage characteristics and qualities needed below an artificial grass system. At the points where the intersecting members 24 meet, the top surface 22 may include a plurality of projections 27. These projections 27 may increase the friction of top surface 22 of the tile 10, for example, on the backing of an artificial grass carpet laid on top of the tile 10.

The tile 10 may also include a bottom portion 28 which includes a bottom surface 30 with a plurality of legs 32 extending therefrom.

The tile 10 may be comprised of two sections 34, 36 flexibly attached to each other by one or more joints 38. The joints 38 allow for the two sections 34, 36 to have some flexibility relative to each other, and may comprise, inverted u-shaped joints 40, or any other joint that will keep the two sections 34, 36 together but provide some flexibility.

It is contemplated that a plurality of tiles 10 will be connected together, and it is contemplated that the connected tiles 10 will form a center strip 42. In order to connect the individual tiles 10 together, the tile 10 may include at least one attachment member 44 and at least one complementary configured attachment member 46. In a preferred embodiment the attachment members 44 are male attachment members and may further comprise, for example, bar attachment members. In this embodiment, the complementary configured attachment members 46 are female attachment members and may comprise inverted u-shaped channels. These types of attachment members are preferred in that they allow a tile to be "pressed down" onto another tile on the ground. Other types of attachment means and members and the number thereof are likewise contemplated for use. In a preferred embodiment, the first side 14, second side 16 and forth side 20 all include attachment member 44 and the third side 18 has complementary configured attachment member 46.

If the strip 42 is formed of a plurality of tiles 10, described in the previous paragraphs, the strip 42 will have two sides 48, 50 with attachment members 44 on both sides 48, 50 which are identical to each other. This will allow additional tiles 52 to be detachably secured to both sides 48, 50 of the center strip 42 at the same time through the use of attachment members 44 and the complementary configured attachment member 46. It is preferred that the additional tiles 52 are those described in U.S. patent application Ser. No. 11,973,645 (published on Sep. 11, 2008 as Pub. No. 2008/0216437). Additionally, as described above, it is preferred that the attachment members 44 on the center strip 42 allow for the additional tiles 52 to be detachably secured with a downward force.

This center strip 42 may be used to form an array of tiles 54 which may form a base for a synthetic grass system. The array 54 generally includes at lease one first tile 56 having a first configuration and at least one second tile 58 and one third tile 60, each having a second configuration. The second configuration is different than the first configuration. The first tile 54 may include a top and a bottom and four sides, wherein three of the sides include an attachment member such as attachment member 44 and the fourth side includes a complementary attachment member, such as complementary attachment member 46. It is contemplated that the first tile 56 is the tile 10 described herein.

The second tile 58 and third tile 60 are connected to opposite sides of the first tile 56. The second tile 58 and third tile 60, as noted above, have the some configuration. For brevity, a contemplated configuration will only be described in relation to the second tile 58. The second tile 58 includes four sides 100, 102, 104, 106. A set of adjacent sides 102 and 104 include the same attachment means, such as for example, attachment members 44. A second set of adjacent sides 100 and 106 include a complementary attachment member such as for example, complementary attachment member 46. Thus, unlike the first tile 56, which has three sides having the same attachment means, the second tile 58 has only two sides with the same attachment means.

Again, utilizing a center strip 42 will allow for an installation team to work faster and install the base in both directions. Therefore, in another aspect of the invention, the present invention is a method of installing a tile base for a synthetic grass system. The method generally includes the steps of providing a first center tile for positioning at an approximate center of a site intended for an artificial turf field, providing a second center tile, attaching the second center tile to the first center tile to form a center strip, attaching a first tile to a first side of the center strip, wherein the first tile has a different configuration than the first and second center tiles, and, attaching a second tile to a second side of the center strip, wherein the second tile has a different configuration than the first and second center tiles.

The method also may include pushing down the second center tile onto an attachment member of the first center tile.

The method may further include pushing down on the first tile onto an attachment member on the first side of the center strip. Similarly, the method may include pushing down on the second tile onto an attachment member on the second side of the center strip. Finally, the method contemplates that attaching the first tile to the first side of the center strip and step of attaching the second tile to the second side of the center strip are performed at approximately the same time.

What is claimed is:

1. An array of tiles forming a base for a synthetic grass system, the array comprising:

a plurality of tiles, a first tile from the plurality of tiles having a first configuration and a second tile and a third tile both having a second configuration;

the second configuration being different than the first configuration;

wherein the first tile comprises a top and a bottom and four sides; and, wherein three of the sides include an attachment member and the fourth side includes a complementary attachment member, wherein the second tile and the third tile are attached to opposite sides of the first tile and wherein the second tile and third tile have four sides, and wherein two adjacent sides each include an attachment member being identical to the attachment member of the first tile, and wherein the other two adjacent sides each include a complementary attachment member being identical to the complementary attachment member of the first tile.

2. The array of claim 1, wherein the first tile further comprises a first section and a second section connected by a flexible joint.

3. The array of claim 2, wherein the flexible joint is a u-shaped joint.

4. The array of claim 1, wherein the first tile, second tile and third tile each include a top surface comprising of a plurality of intersecting members.

5. The array of claim 2 further comprising a fourth and fifth tile, the fourth tile attached to the second tile, and the fifth tile attached to the third tile, wherein the fourth and fifth tile have a configuration being the same as the configuration of the third tile.

6. An array of tiles forming a base for a synthetic grass system, the array comprising:

a plurality of tiles, wherein a first tile from the plurality of tiles includes three sides each having a first attachment member and a fourth side having a second attachment member; and, wherein a second tile and a third tile from the plurality of tiles both include a first set of adjacent sides each having a third attachment member and a second set of adjacent sides each having a fourth attachment member;

the first attachment member and the third attachment member being the same;

the second attachment member and the fourth attachment member being the same;

the first and the third attachment members being configured complementary to the second and fourth attachment members;

wherein the second tile and third tile are attached to opposite sides of the first tile.

7. The array of claim 6 wherein a plurality of first tiles are attached together to form a strip.

8. The array of claim 6 wherein the first tile further comprises a top surface having a plurality of intersecting members.

9. The array of claim 8 wherein the first tile further comprises at least one projection disposed at a point of intersection of the intersecting members and extending away therefrom.

10. The array of claim 6 wherein the first tile further comprises a bottom surface with a plurality of legs extending away therefrom.

11. The array of claim 6 wherein the first tile further comprises a first section and a second section, the first section and the second section being connected by a flexible joint.

12. The array of claim 11 wherein the flexible joint is a u-shaped joint.

13. The array of claim 6 wherein the first attachment member is a bar attachment member and wherein the second attachment member is an inverted u-shaped attachment member.

* * * * *